US009428253B1

(12) United States Patent
Morgan et al.

(10) Patent No.: US 9,428,253 B1
(45) Date of Patent: Aug. 30, 2016

(54) APPARATUS AND METHOD FOR CONVERTING STAND UP PADDLEBOARD TO A SCULLING BOAT

(71) Applicants: Dean Morgan, Horseshoe Bay, TX (US); Jeanna Jette, Spicewood, TX (US)

(72) Inventors: Dean Morgan, Horseshoe Bay, TX (US); Jeanna Jette, Spicewood, TX (US)

( * ) Notice: Subject to any disclaimer, the term of this patent is extended or adjusted under 35 U.S.C. 154(b) by 0 days.

(21) Appl. No.: 14/242,565

(22) Filed: Apr. 1, 2014

Related U.S. Application Data

(60) Provisional application No. 61/807,360, filed on Apr. 2, 2013.

(51) Int. Cl.

| | |
|---|---|
| ***B63B 35/79*** | (2006.01) |
| ***B63B 35/73*** | (2006.01) |
| ***B63H 16/00*** | (2006.01) |
| ***B63H 16/04*** | (2006.01) |
| ***B63H 16/073*** | (2006.01) |
| ***B63H 1/36*** | (2006.01) |

(52) U.S. Cl.
CPC ..... *B63B 35/7933* (2013.01); *B63H 1/36* (2013.01); *B63H 16/04* (2013.01); *B63H 16/073* (2013.01)

(58) Field of Classification Search
CPC .... B63B 35/7933; B63H 1/36; B63H 16/04; B63H 16/073; A63B 69/06
USPC ..... 114/343, 363, 364; 440/101–108; 441/66, 74
See application file for complete search history.

(56) References Cited

U.S. PATENT DOCUMENTS

| | | | | |
|---|---|---|---|---|
| 3,898,950 | A * | 8/1975 | Martin | 440/105 |
| 5,899,780 | A * | 5/1999 | Robbins | 440/105 |
| 6,035,799 | A * | 3/2000 | Lukanovich et al. | 114/343 |
| 6,467,665 | B1 * | 10/2002 | Jenkins | 224/628 |
| 6,682,462 | B1 * | 1/2004 | Lee | 482/72 |
| 7,662,006 | B2 * | 2/2010 | Mollis | 441/65 |
| 7,731,637 | B2 * | 6/2010 | D'Eredita | A63B 21/154 482/138 |
| 2008/0302293 | A1 * | 12/2008 | Nesseth | 114/363 |

FOREIGN PATENT DOCUMENTS

GB 321362 A * 11/1929

* cited by examiner

*Primary Examiner* — Anthony Wiest
(74) *Attorney, Agent, or Firm* — Rick B. Yeager

(57) ABSTRACT

A rowing device conversion kit for a stand up paddleboard (SUP) includes a frame assembly with seat tracks; a seat assembly with a rolling seat; and a rigger assembly. The frame assembly is attached to the SUP with four attachment clamps that each engage a portion of a rail of the stand up paddleboard. Universal attachment clamps are metal coated in non-slip plastic or rubber, so that the clamps conform to the profile of the rails. The clamps are strapped to the frame assembly by wrapping straps around the frame; tightening the straps; and buckling the straps. A locking mechanism keeps the seat in place as the user is climbing on or off the SUP. The rowing mechanism folds up into a bag the size of a golf club bag. The rigger detaches from the framework and breaks down into two pieces.

20 Claims, 14 Drawing Sheets

APPARATUS AND METHOD FOR CONVERTING STAND UP PADDLEBOARD TO A SCULLING BOAT

BACKGROUND

1. Field of Invention

The current invention relates to an apparatus and method for adding a movable seat, rigger, oarlocks, and foot support to convert a stand up paddleboard (SUP) to a sculling boat.

2. Prior Art

The prior art includes various additions of seats to sailboards and other flotation devices.

U.S. Pat. No. 5,377,607 to Ross describes a multi-functional accessory arrangement for converting a sail board into a paddling craft, rowing craft or conventional sailing craft consisting of a sail board hull having a multi-functional seat including an associated back support adapted to be adjustable between a sailing/hiking position, rowing position and paddling position said seat connected to the sail board hull permitting movement of the seat between a forward position and an aft position, a multi-functional propulsion kit for selectively transforming the sail board into a sail boat, a row boat or a kayak board said kit including a hiking device connected to the chassis for use in counter balancing heeling of the hull responsive to the action of wind acting on the sail, a pedestal console for controlling the movement of the sail board including a centerboard, a manual steering device with rigging for controlling a sail, oar locks for use with oars and boom.

US Patent Publication No. 20120077396 to Lipman describes a paddled watercraft that is readily convertible between a stand-up paddleboard configuration and a seated paddling configuration. The watercraft includes a board with an operator body support assembly attached onto the top deck of the board, the body support assembly being capable of being reconfigured to support a person in a standing position for padding from a standing position, or to support a person in a seated position for paddling from a seated position. The watercraft can be converted from stand-up paddling configuration to a seated paddling configuration while underway on open waters.

SUMMARY OF INVENTION

In one embodiment of the current invention, a stand up paddleboard is converted to permit sculling. While rowing, the rower sits in the boat facing backwards, towards the stern, and uses the oars which are held in place by oarlocks to propel the boat forward, towards the bow. The sport requires strong core balance as well as physical strength and cardiovascular endurance. In sculling, the rower has two oars, or sculls, one in each hand.

The two fundamental reference points in the rowing stroke are the catch, immediately prior to the oar blade's placement in the water, and the extraction where the rower removes the oar blade from the water. At the catch, the rower places the blade in the water, then applies pressure to the oar by simultaneously pushing the seat toward the bow of the boat by extending the legs. As the legs approach full extension, the rower pivots his torso toward the bow of the boat and then finally pulls the arms towards his chest.

In the recovery phase, the rower compresses the legs which moves the seat towards the stern of the boat. The leg compression occurs relatively slowly, which affords the rower a moment to "recover", and allows the boat to glide through the water. A controlled slide of the seat is necessary to maintain momentum and achieve optimal boat run.

Sculling boats cost between $10,000 and $20,000 whereas a stand up paddleboard (SUP) and SwitchSUP™ rowing mechanism of the current invention will be in the $1,500-$2,500 range.

Sculling boats can be 24-30 feet long, making them difficult to travel with and to store. Stand up paddleboards can be as small as a backpack (inflatables) up to 14 feet in length, making them easy to transport and store. They are also significantly lighter than a sculling boat.

In one embodiment, the rowing mechanism for the stand up paddleboard will fold up into a bag the size of a golf club bag. The rigger detaches from the framework and breaks down into two pieces. This allows it to fit into the trunk of a car or a small apartment closet with ease. The stand up paddleboard and rowing mechanism, when broken down, will provide a "sculling boat" that can be checked onto an airplane, thereby allowing the user to take their hobby and workout with them when they travel. Due to the structure of stand up paddleboards, they are more stable than sculling boats, making them easier for beginners or those with poor balance to use. Sculling with the stand up paddleboard is much quicker on the water than the traditional method of paddling.

Despite the differences in size and stability, the same rowing workout of a sculling boat can be achieved with the SwitchSUP rowing mechanism attached to a stand up paddleboard. The stand up paddleboard becomes a dual-purpose boat, because you can stand up and paddle on it or row it as a sculling boat.

DESCRIPTION OF EMBODIMENT

Figure 1:
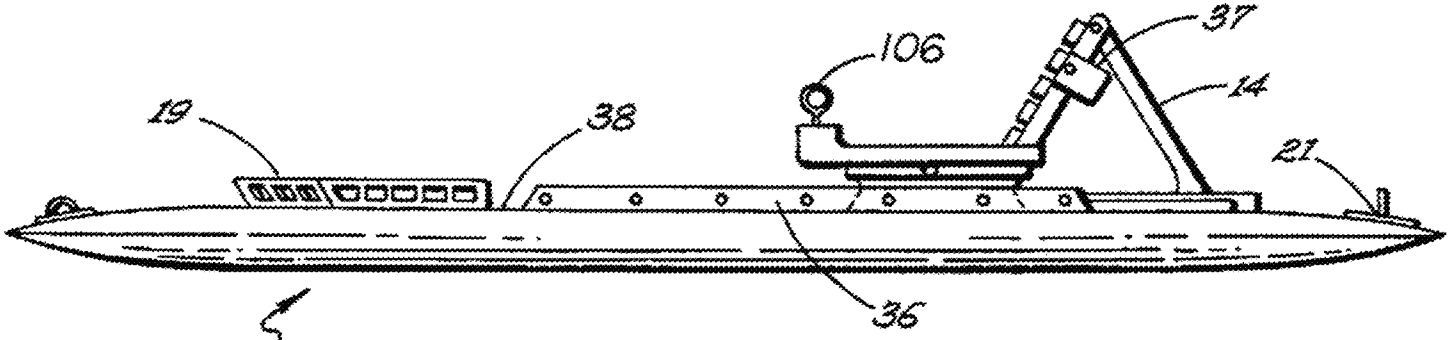
FIG. 1 (Prior Art)
FIG. 1 is a prior art device of U.S. Pat. No. 5,377,607 to Ross
Figure 2:
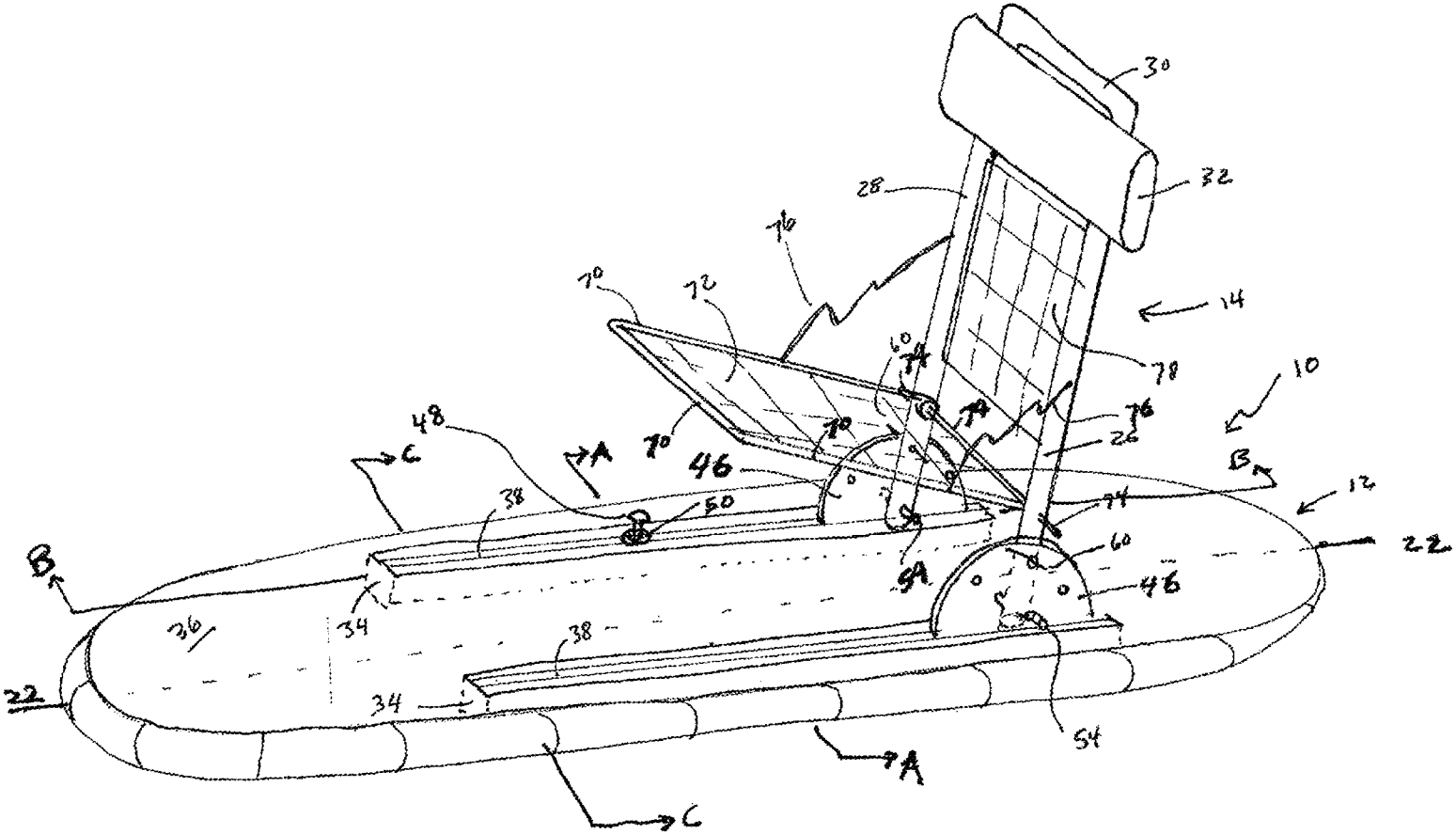
FIG. 2 (Prior Art)
FIG. 2 is a prior art device of US Patent Publication No. 20120077396 to Lipman

The following element numbers referenced in the drawings are provided for convenience.

- Stand up paddleboard 80
  - top surface 81
  - rails 82, 83
- rowing device conversion kit 100
  - frame assembly 120
    - foot frame member 121
    - head frame member 122
    - side members 124, 125
      - seat tracks 126, 127
    - SUP attachment clamps 130
      - SUP clamping region 132
        - strap slot 134
      - strap 135
        - strap buckle 136
    - foot plate support angle members 140, 141
  - seat assembly 160
    - seat 161
      - fender 162
    - roller seat frame 163
      - seat elevation support 164
      - seat track retaining bracket 165
    - wheels 166
    - locking mechanism 167
      - locking seat position knob 167
      - indexing seat-position holes 128
  - foot plate assembly 170
    - foot plate 171
    - bindings 172, 173
    - heal straps 174, 175
    - mirror 190
    - gusset 195
  - rigger assembly 180
    - rigger frame 182
      - side arms 183, 184
        - spring pin hole 192
        - spring pin 193
      - lower frame 185
      - oarlocks 186
      - gusset alignment pin 196

Stand Up Paddleboard (SUP) and Rowing Device Frame Attachment

Stand up paddleboards can be constructed of multiple materials, and the thickness of the boards varies. Stand up paddleboards can be found in materials such as epoxy, fiberglass, inflatables, crosslink polyethylene, and soft-top.

Figure 3:
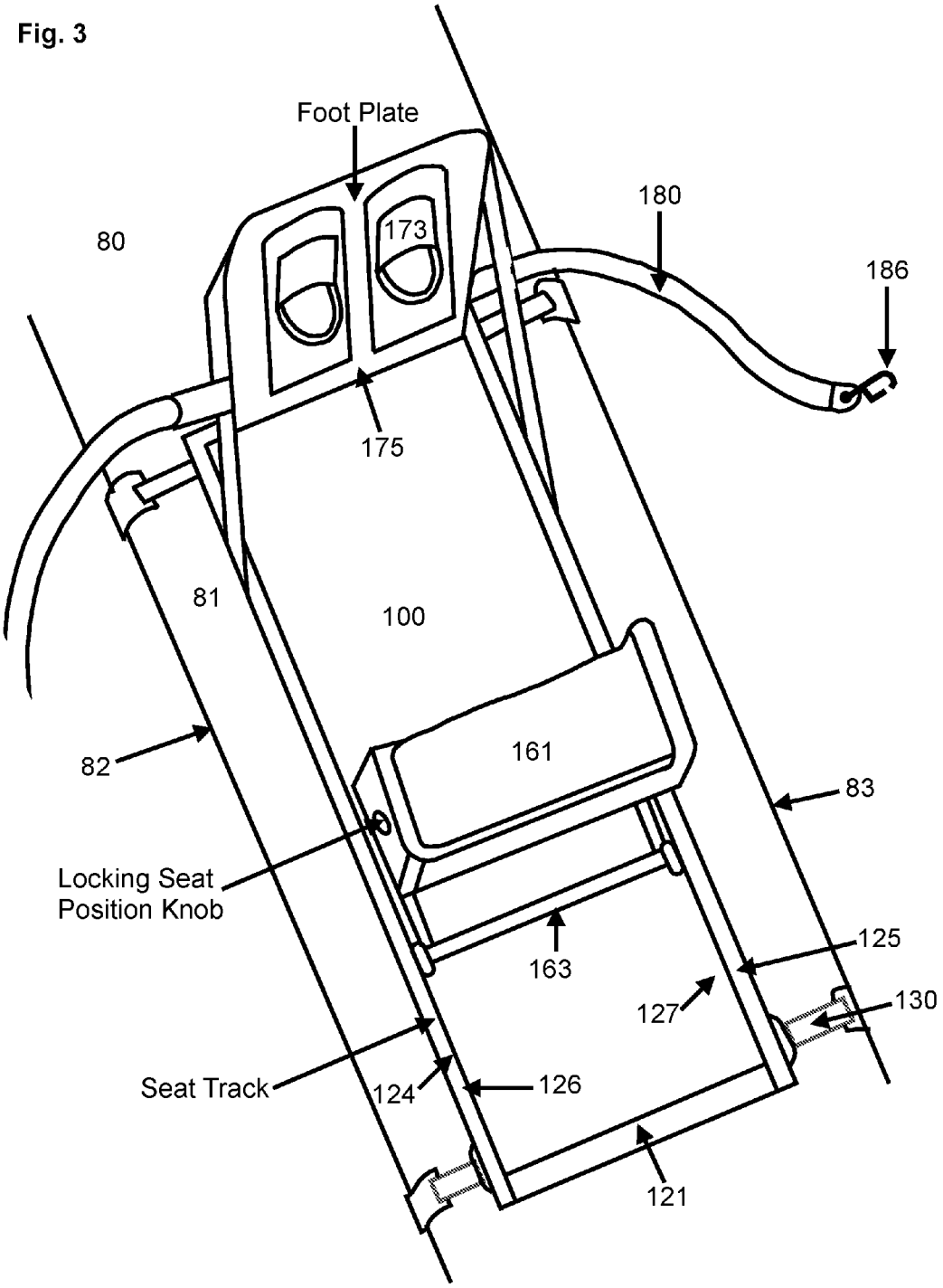
FIG. 3 is a top perspective view of an embodiment of a converted paddleboard of the current invention showing a frame assembly, seat assembly, foot assembly, and rigger assembly removably attached to a stand up paddleboard.

FIG. 3 shows a Stand up paddleboard 80 with a top surface 81 and rails 82 and 83.

In this embodiment, a rowing device conversion kit 100 is removably attached to the stand up paddleboard 80. The rowing device conversion kit 100 comprises a frame assembly 120 with a foot frame member 121, a head frame member 122, and side members 124, 125. The inward-facing portions of the side members serve as seat tracks 126 and 127.

In this embodiment, the frame assembly is attached to the stand up paddleboard with four SUP attachment clamps 130 so that the SUP clamping region 132 of each attachment clamp engages a portion of one of the rails of the stand up paddleboard. In other examples, other numbers of clamps or other attachment means may be used.

There are several methods of attaching a support frame, such as a rowing device conversion kit frame assembly 120 to a stand up paddleboard. One method is to strap the rowing mechanism to the board by wrapping straps around the entire board. This can be awkward to install and creates drag in the water. The strap can also scratch or deform the board.

Another attachment method is to glue mounting tabs or brackets to the board. Glue will not adhere to certain types of boards and may fail after prolonged exposure to sunlight and heat on other boards. The glue requires a specific curing period before use and is a permanent installation, making it so the rowing mechanism is not adaptable from one board to another. Boards are typically lightweight and the tabs can be torn from the board while still adhered to the surface material, causing damage.

Figure 4:
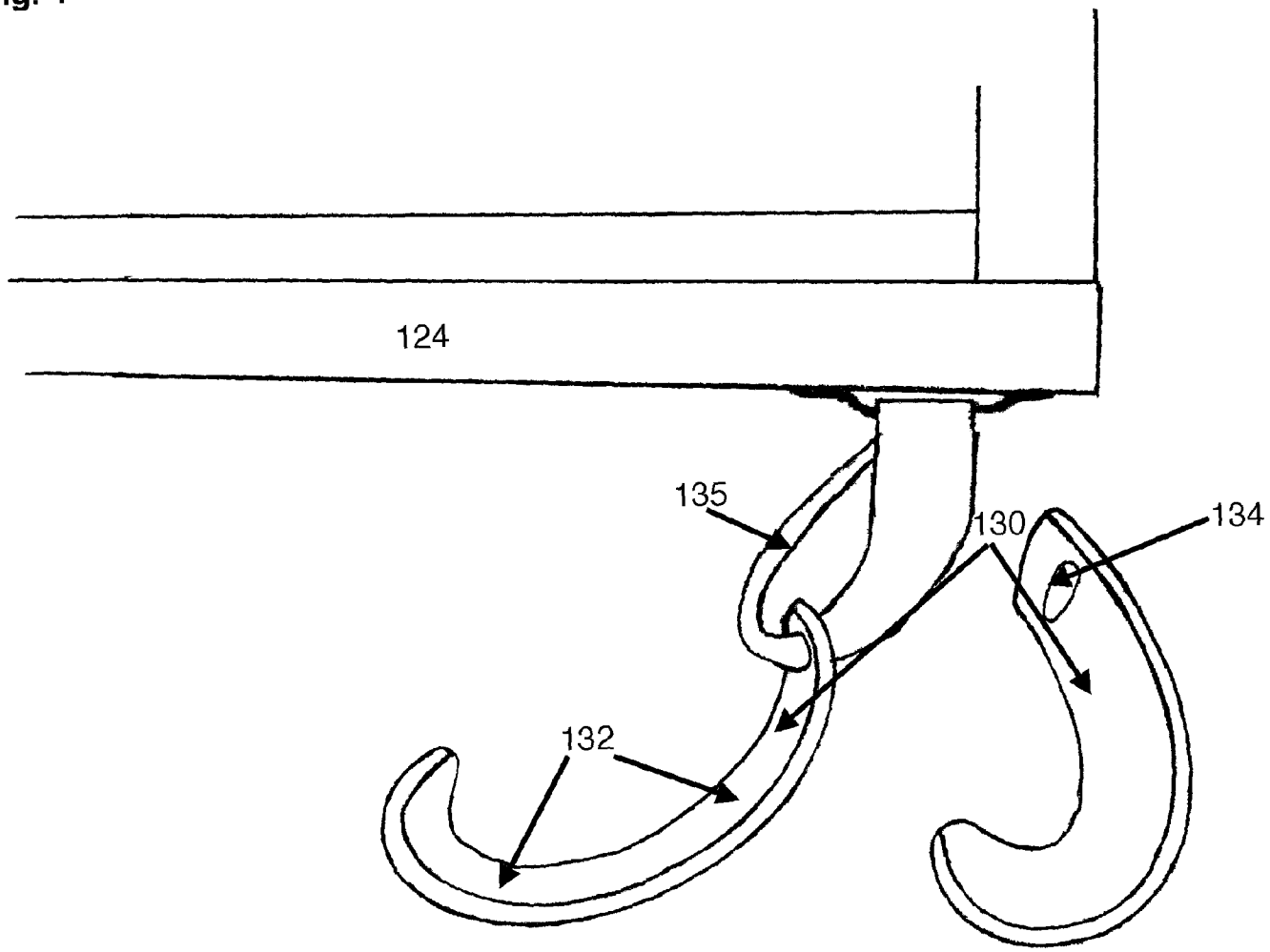
FIG. 4 is a side perspective view of a portion of the frame positioned on the stand up paddleboard of FIG. 3.
Figure 5:
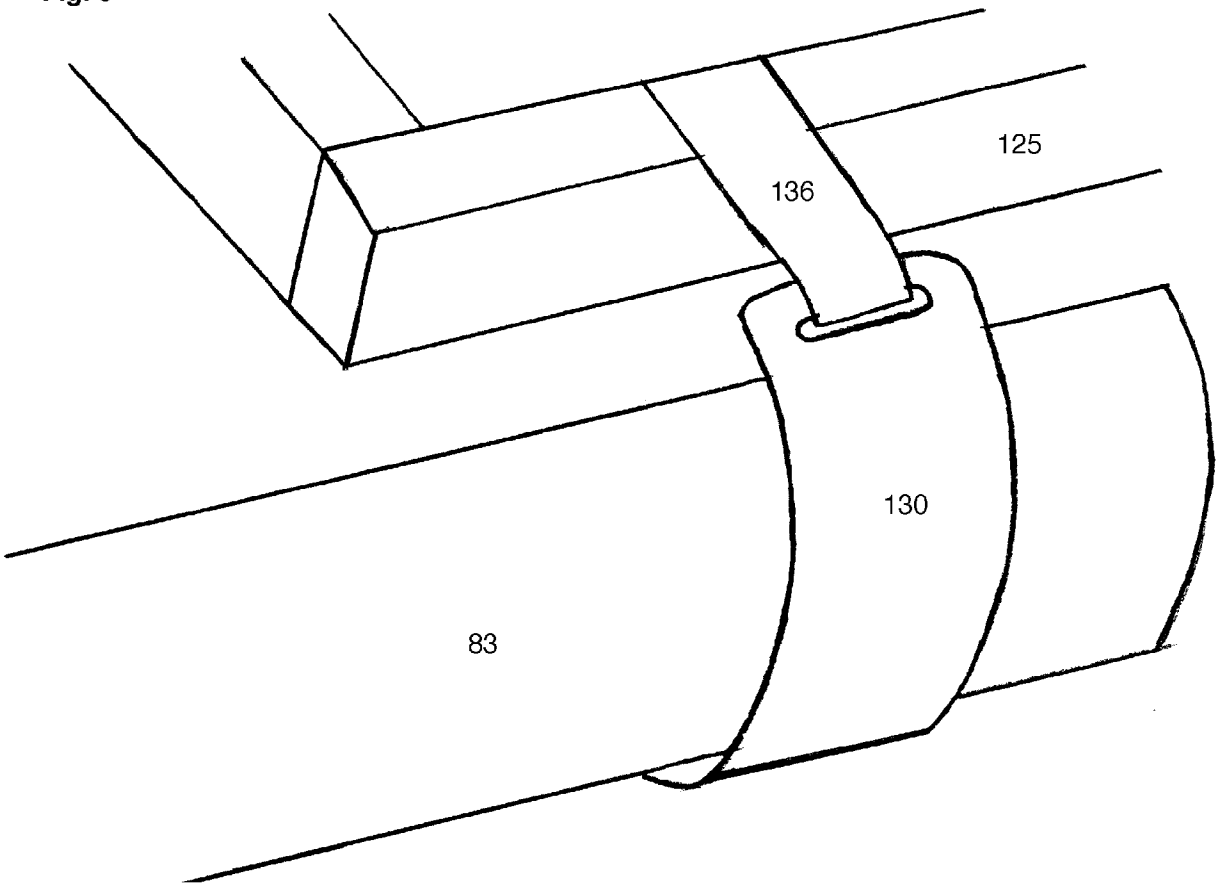
FIG. 5 is a side perspective view of a portion of the frame attached to the stand up paddelboard of FIG. 3 with an attachment clamp.

FIG. 4 is a side perspective view of a portion of the frame positioned on the stand up paddelboard of FIG. 3. FIG. 5 is a side perspective view of a portion of the frame attached to the stand up paddelboard of FIG. 3 with an attachment clamp.

In this embodiment, the SUP attachment clamps 130 are metal which is coated in non-slip, scratch resistant plastic or rubber, so that the clamps conform to the profile of the rails 82 and 83 of the stand up paddleboard 80. In other examples, the SUP attachment clamps may be constructed of a plastic or reinforced plastic. The clamps are strapped to the frame assembly by wrapping straps 135 around the frame; tightening the straps; and buckling the straps with strap buckles 136. A strap slot 134 is provided in each SUP attachment clamp.

The clamp attachment provides a universal attachment to all board-types and to varying thicknesses of the rails. It is not a permanent installation and, therefore, can be moved from board to board. It is simple to set up and does not require a curing period after installation. It does not create drag in the water.

This attachment method can be used to attach other items to the stand up paddleboard, such as outriggers, pontoons, SCUBA tank holders, tackle boxes, ice chests, kayak seats, seats, gear boxes, anchors, seats, duck or hunting blinds, and camping gear storage.

Seat Assembly

Figure 6:
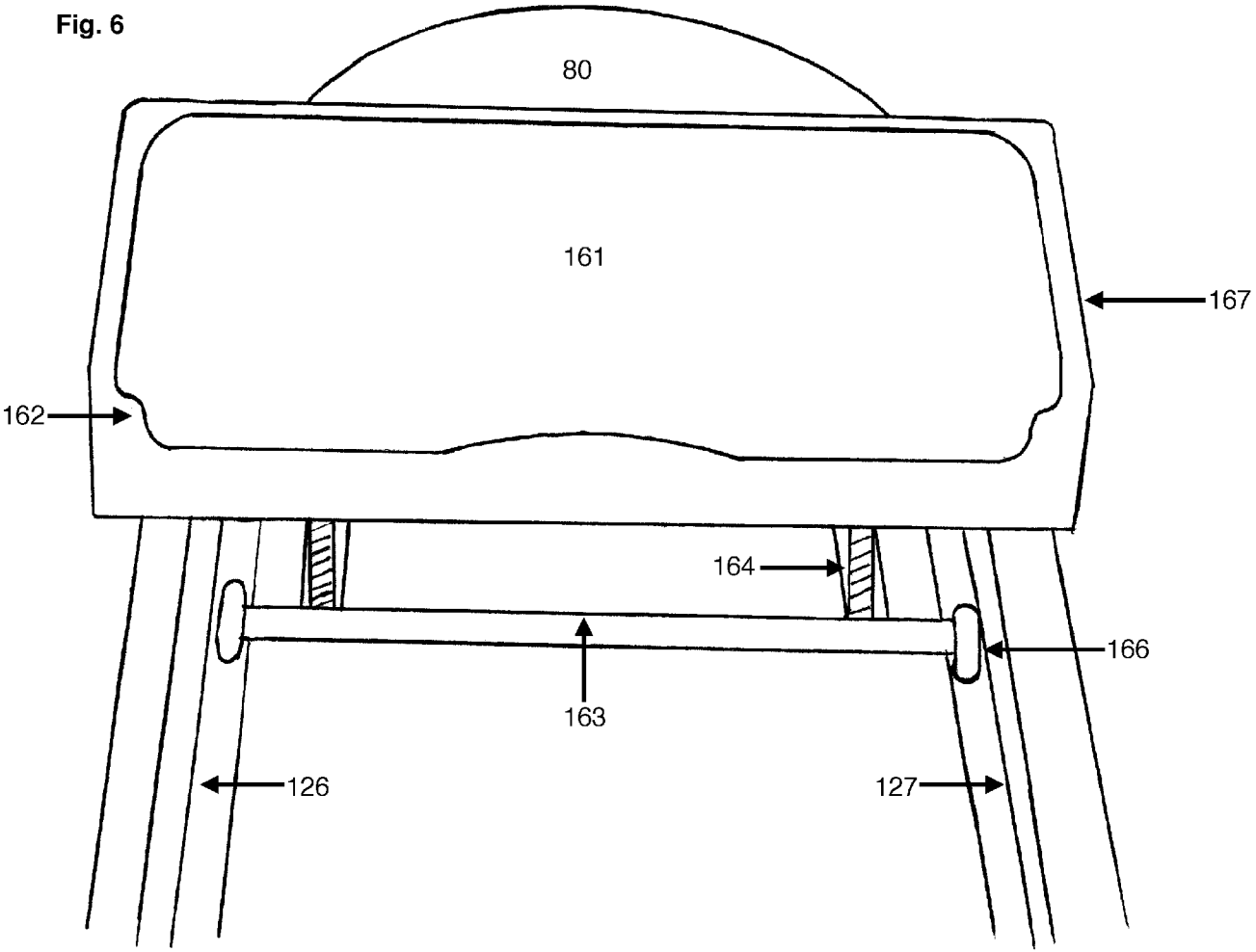
FIG. 6 is a front view of the seat of the converted stand up paddelboard of FIG. 3 showing a seat assembly positioned in the seat tracks of the frame assembly.
Figure 7:
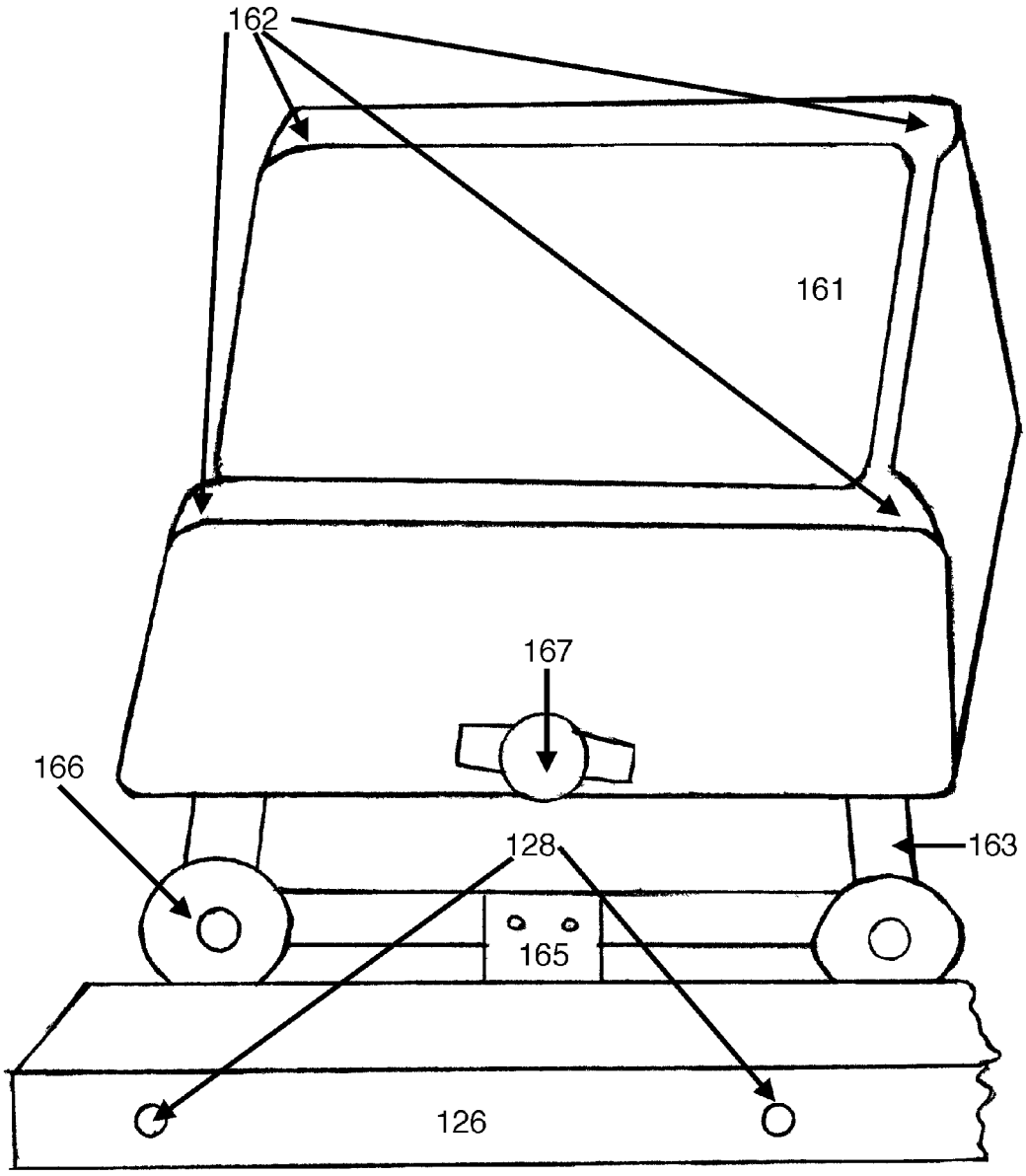
FIG. 7 is a side perspective view of the seat assembly of FIG. 6.
Figure 8:
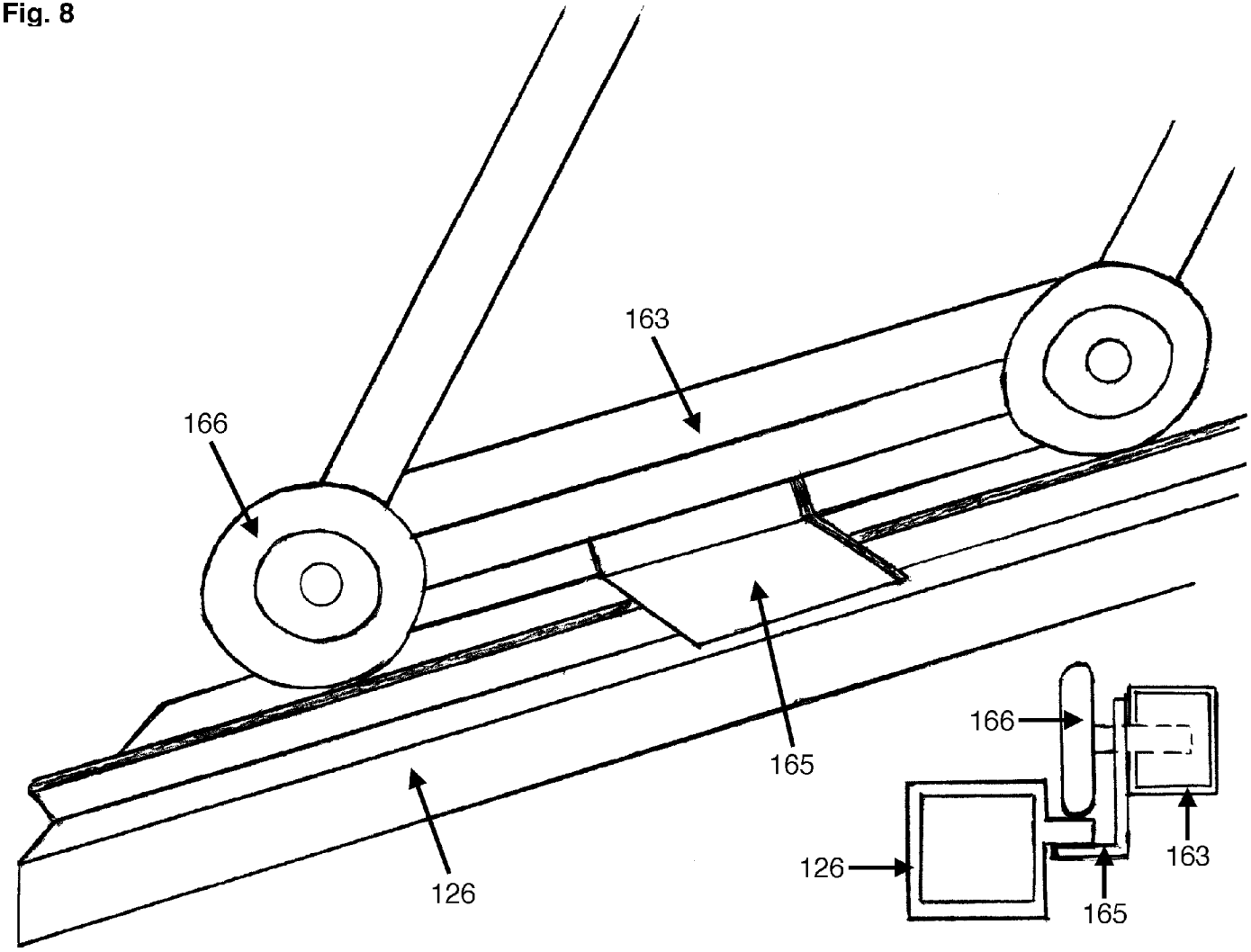
FIG. 8 is a bottom perspective view of a roller seat frame of the seat assembly of FIG. 3

FIGS. 6-8 show details of a seat assembly. FIG. 6 is a front view of the seat of the converted stand up paddelboard of FIG. 3 showing a seat assembly positioned in the seat tracks of the frame assembly. FIG. 7 is a side perspective view of the seat assembly of FIG. 6. There are several shortcomings associated with a traditional sculling seat. Wheels are exposed and cannot be locked into position, making it difficult to climb on from the dock and get centered into position. The seat often rolls backward or forward as the user is climbing onto the boat, depending on weight distribution and waves. Balance is paramount and, if the seat is missed, the rower may end up in the water.

In this embodiment, the seat 161 has a locking mechanism 167 to keep the seat in place as the user is climbing on or off the stand up paddleboard, thus allowing the user to enter and exit safely.

In one example, the locking mechanism 167 comprises a locking seat position knob 168 which engages one of a plurality of indexing seat-position holes 128 which are provided in a frame side member. The locking mechanism 167 can position the seat in several locations, thereby allowing the user to scull with the mechanism unengaged or row with a stationary seat in the engaged position. In other examples, a pin or a clamp maybe used to lock the seat into place.

When the mechanism is unengaged and the seat rolls on the tracks, the user works his or her legs, abdominals, arms, shoulders, and back. When the mechanism is engaged, the seat doesn't move, and the user works his or her arms, shoulders, back, and abdominals.

In this embodiment, the seat assembly 160 comprises a seat 161 supported on a seat roller frame 163 with a seat elevation support 164. Wheels 166 are provided on the roller seat frame, so that when the locking mechanism is unengaged, the wheels roll in seat tracks 126 and 127. FIG. 8 is a bottom perspective view of a roller seat frame of the seat assembly of FIG. 3. A seat track retaining bracket 165 retains the seat relative to the seat tracks.

Exposed wheels are a hazard to user's hands and fingers, as well as to clothing. Clothing can be caught and damaged in the wheels as the seat rolls back and forth on the tracks and has potential to trap the rower to the boat. Fingers and hands can also be run over and crushed under the weight of the user. In this embodiment, the seat has integrally molded fenders 162, protecting the user and his or her clothing from the wheels.

Foot Plate Assembly

In this example, the footplate is provided at a fixed position on the frame. To adjust the footplate on a traditional sculling boat, one must reposition the plate in relationship to the deck of the boat. In another example, the framework of the footplate can be lengthened, much like a wheeled suitcase handle extends, allowing varying heights of users to perform proper rowing technique in a comfortable position in relationship to the rigger and oarlocks.

Figure 9:
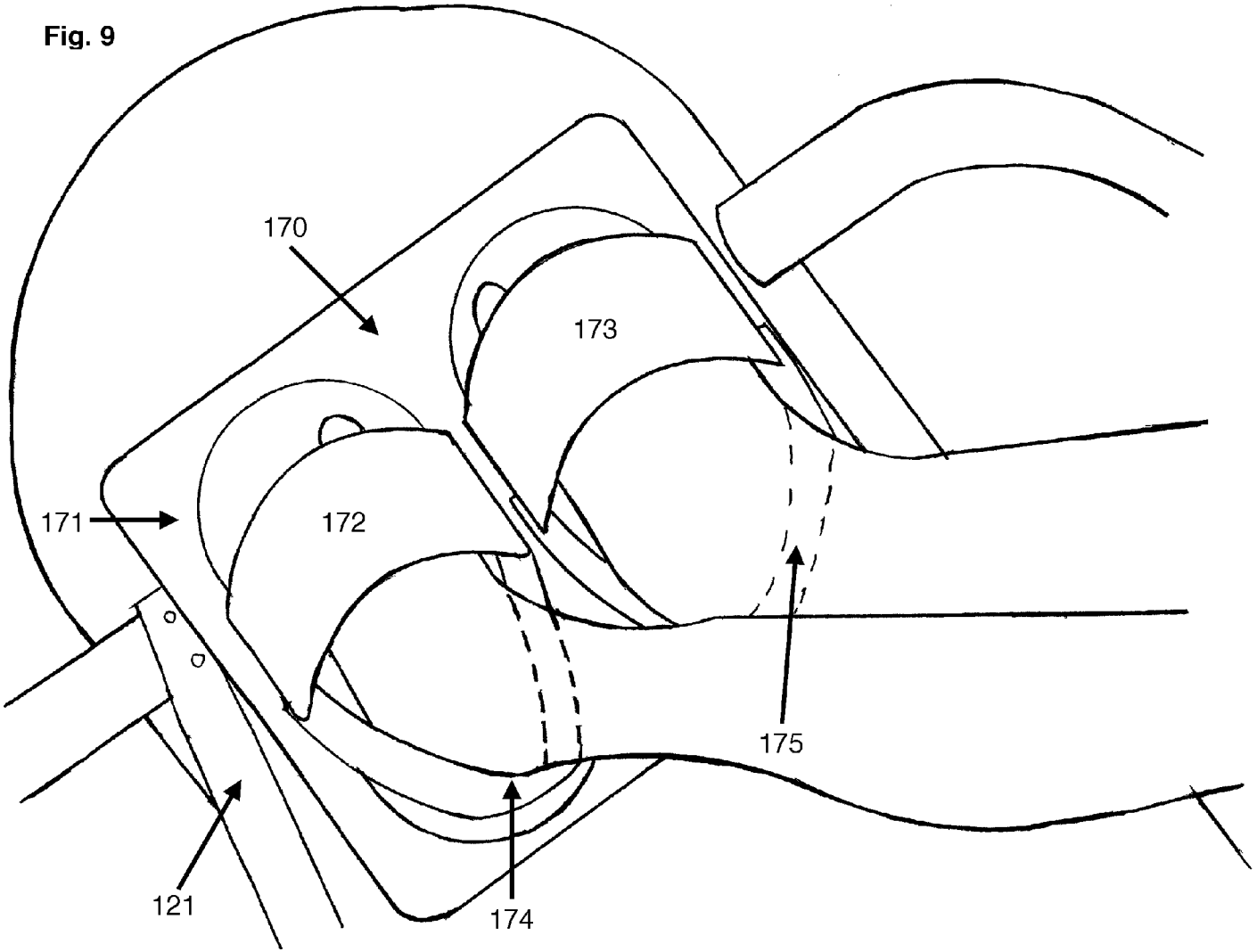
FIG. 9 is a top perspective view of a foot assembly.

FIG. 9 is a top perspective view of a foot assembly 170 showing a foot plate 171 attached to foot plate support angle members 140 and 141. The foot plate includes bindings 172 and 173, and heal straps 174 and 175.

Exercise Assembly

In this example, the bindings are resistance bands with molded handles can be attached to the footplate on the mechanism. Bands come in different strengths, allowing the user to customize his or her workout.

Rigger Assembly

Figure 10:
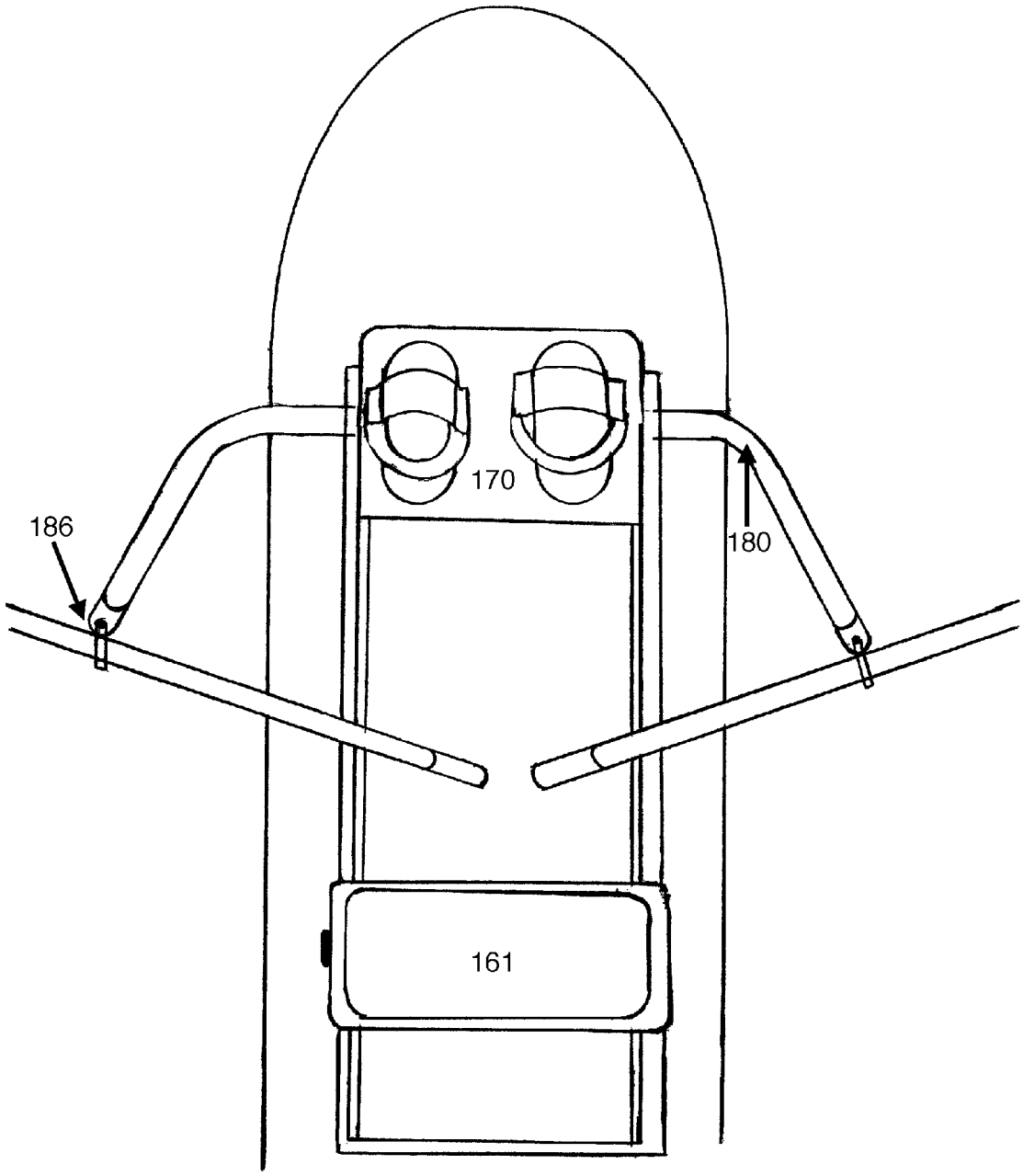
FIG. 10 is a top perspective view of a rigger assembly, foot assembly, frame assembly, and seat assembly secured to a stand up paddleboard.

FIG. 10 is a top perspective view of a rigger assembly, foot assembly, frame assembly, and seat assembly secured to a stand up paddleboard. In this example, the rigger assembly 180 includes a rigger frame 182 with bent side arms 183 and 184 and a lower frame 185 which is secured the foot plate and rigger. Oarlocks 186 are provided on the side arms.

Figure 12:
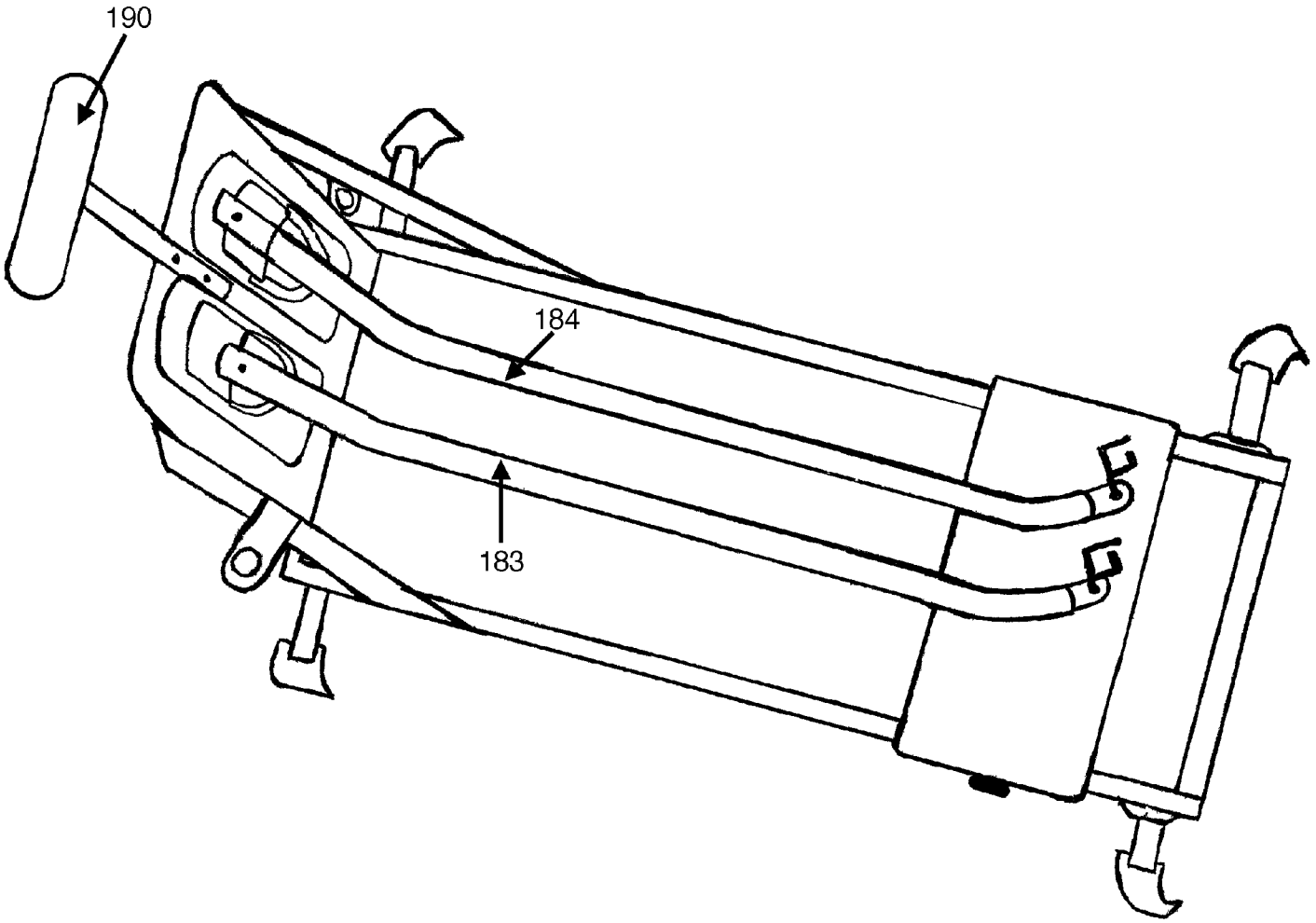
FIG. 12 is a top perspective view of an example rowing device conversion kit with the rigger disassembled.

FIG. 12 is a top perspective view of an example rowing device conversion kit with the rigger disassembled so that the two arms 183 and 184 rest within the frame. In this example, a mirror 190 is supported from the foot plate.

Figure 13:
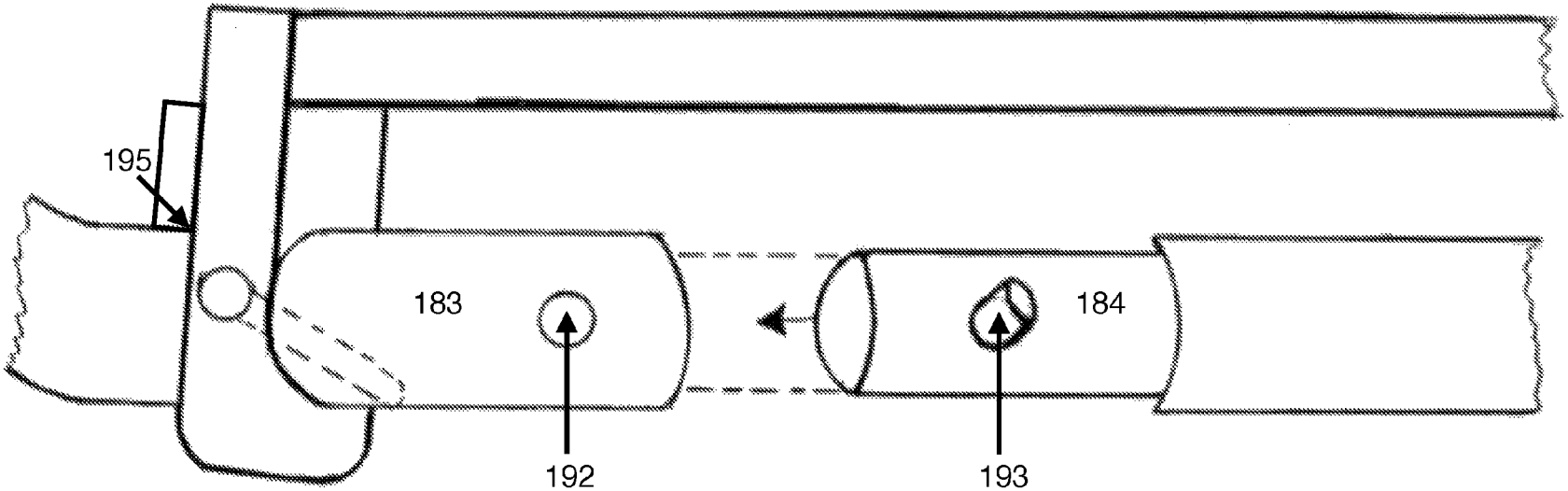
FIG. 13 is a front view of rigger parts being assembled.

FIG. 13 is a front view of rigger arms 183 and 184 being assembled. A spring pin 193 on arm 184 mates with a spring pin hole 192 is on arm 183. The spring pin is depressed to disassemble the rigger.

Figure 14:
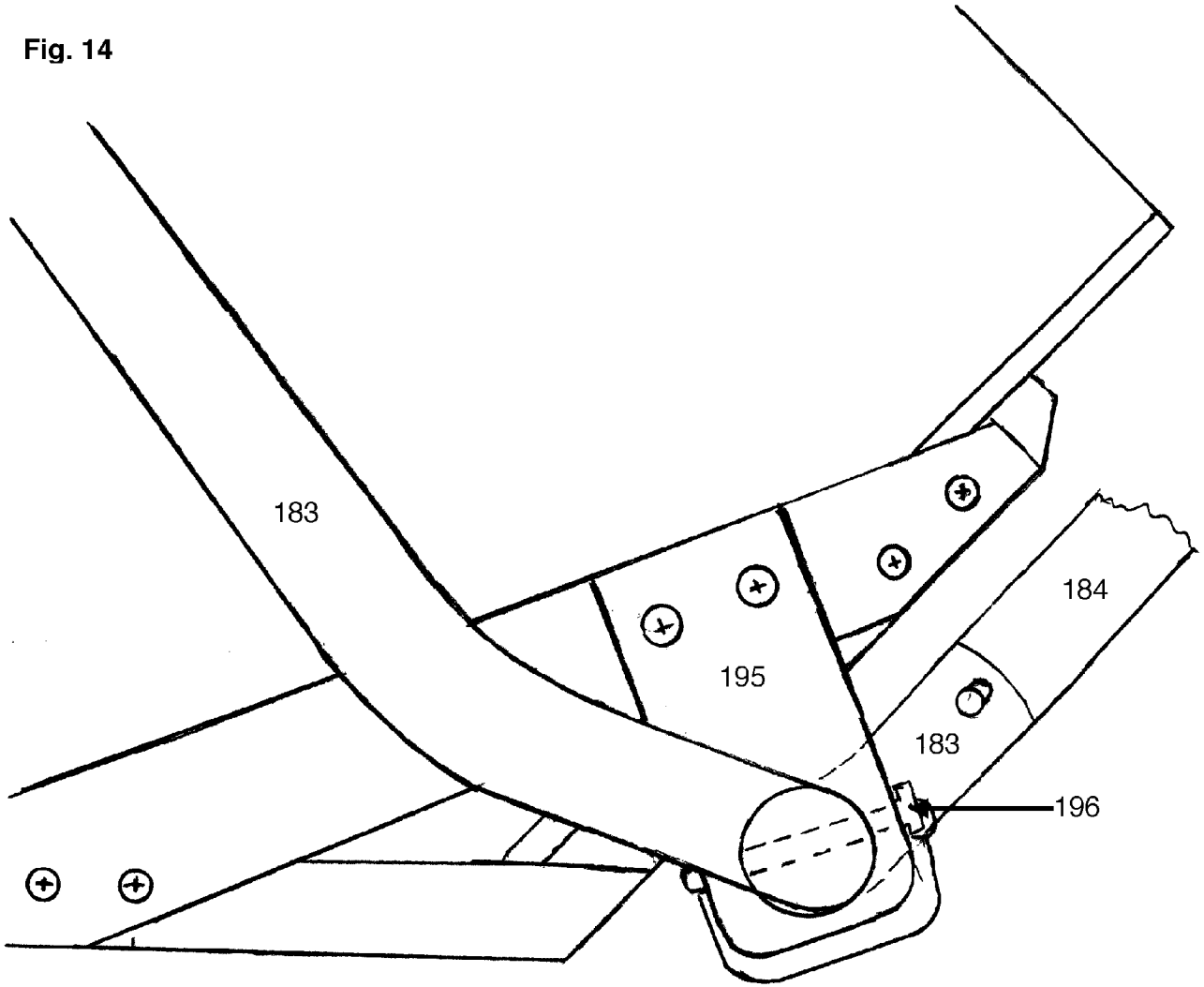
FIG. 14 is a side perspective view of an assembled rigger showing a support gusset and gusset alignment pin.

FIG. 14 is a side perspective view of an assembled rigger showing a support gusset and gusset alignment pin. The rigger breaks down into two pieces 183 and 184, for easy transport and storage. The two rigger pieces, when being put together for use, thread through two gussets 195, one on each side of the foot plate assembly. They meet in the center and click together with a spring pin locking mechanism. Once the two pieces are locked together in the center, a gusset alignment pin 196 is pushed through holes in the gussets and rigger to hold the rigger at the appropriate angle for optimum rowing. The material of the rigger bracket, or gusset, can be manufactured out of aluminum or high density plastic that will not scratch the rigger material.

Figure 11:
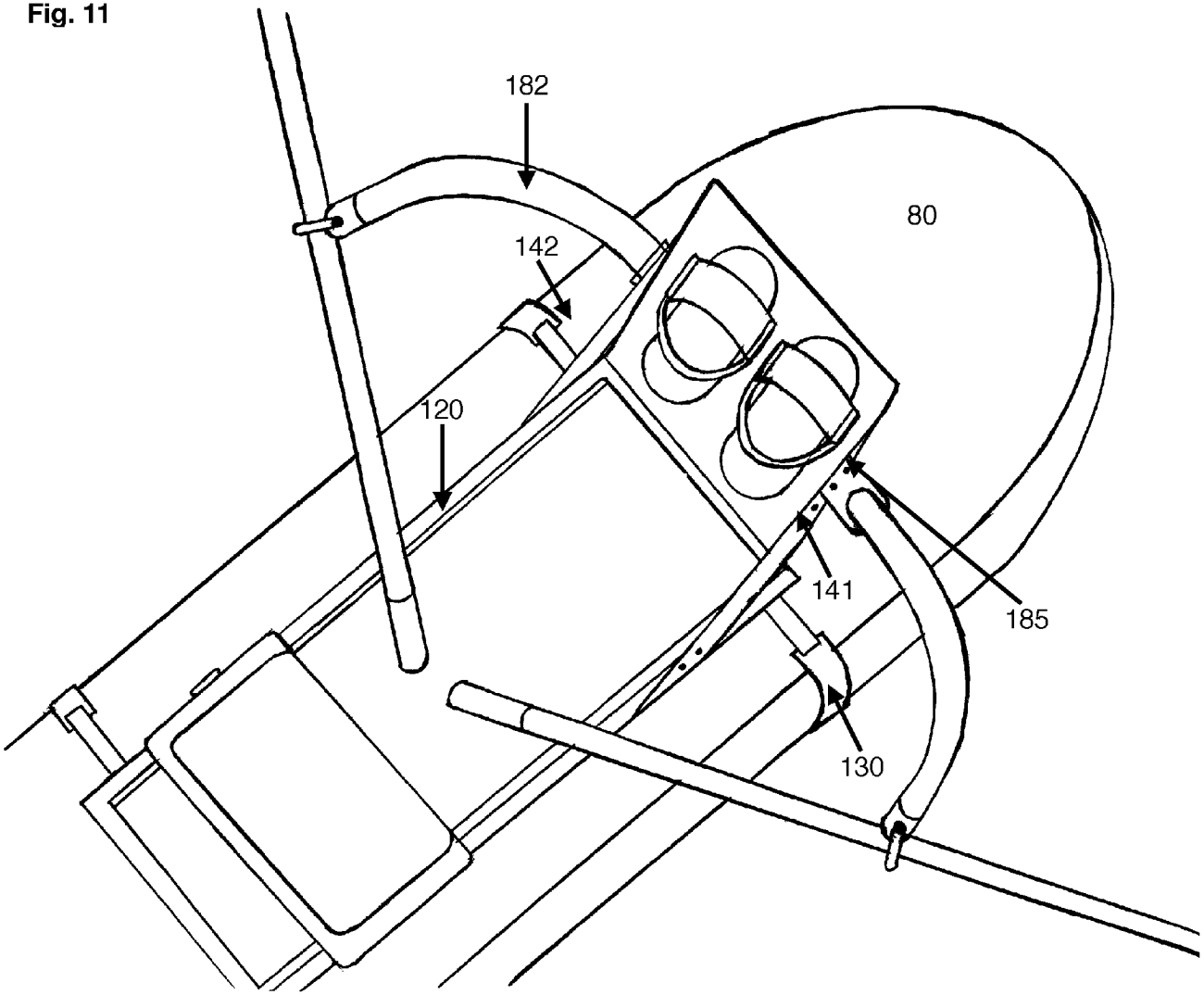
FIG. 11 is a top perspective view of an example rowing device conversion kit attached to a stand up paddleboard.

FIG. 11 is a top perspective view of an example rowing device conversion kit attached to a stand up paddleboard.

Methods of Assembly and Use

The rigger breaks down into two pieces, for easy transport and storage. The two rigger pieces, when being put together for use, thread through two gussets, one on each side of the foot plate assembly. They meet in the center and click together with a locking mechanism. Once the two pieces are locked together in the center, a pin is pushed through holes in the gussets and rigger to hold the rigger at the appropriate angle for optimum rowing. This connects the rigger to the rest of the sculling assembly, which includes the foot plate assembly, seat track and seat. Once the rigger is connected to the rest of the assembly, the entire assembly can be attached to the board with one of the attachment methods. The material of the rigger bracket can be manufactured out of aluminum or high density plastic that will not scratch the rigger material.

The removable rowing device conversion kit can also be used as a rowing machine without a stand up paddleboard, off the water.

In one embodiment, the rowing mechanism for the stand up paddleboard will fold up into a bag the size of a golf club bag. The rigger assembly detaches from the frame and breaks down into two pieces by removing a pin out of a coupling splice lock at the center of the rigger. Two additional pins must be pulled out of the rigger slide ports to the left and right of the foot support to complete the breakdown of the rigger. This allows it to fit into the trunk of a car or a small apartment closet with ease.

The stand up paddleboard and rowing mechanism, when broken down, will provide a "sculling boat" that can be checked onto an airplane, thereby allowing the user to take their hobby and workout with them when they travel. Due to the structure of stand up paddleboards, they are more stable than sculling boats, making them easier for beginners or those with poor balance to use. Sculling with the stand up paddleboard is much quicker on the water than the traditional method of paddling.

Despite the differences in size and stability, the same rowing workout of a sculling boat can be achieved with the SwitchSUP rowing mechanism attached to a stand up paddleboard. The stand up paddleboard becomes a dual-purpose boat, because you can stand up and paddle on it or row it as a sculling boat.

It is to be understood that the specific embodiments and examples described above are by way of illustration, and not limitation. Various modifications may be made by one of ordinary skill, and the scope of the invention is as defined in the appended claims.

What is claimed is:

1. A rowing device conversion kit for a stand up paddleboard having a top surface and rails, the conversion kit comprising a frame assembly comprising
- side members with seat tracks, and
- a plurality of frame attachment clamps, such that the frame attachment clamps
- engage the rails of the stand up paddleboard, thereby securing the frame assembly
- to the top surface of the stand up paddleboard;

a seat assembly comprising
- a roller seat frame,
- a seat, and
- a plurality of wheels supported in the seat tracks;

a foot plate assembly comprising a first side gusset and a second side gusset; and a rigger assembly comprising
- a first side arm comprising
  - a lower portion extending through the first side gusset, and
  - an elevated portion, a first side gusset alignment pin configured to secure the first side arm to the first side gusset, a second side arm comprising, a lower portion extending through the second side gusset, and an elevated portion, a second side gusset alignment pin configured to secure the second side arm to the second side gusset, and a pair of oarlocks attached to the elevated portions of the side arms.

2. The rowing device conversion kit of claim 1 wherein the plurality of frame attachment clamps further comprise straps and buckles, such that the straps can be tightened to secure the attachment clamps and frame assembly.

3. The rowing device conversion kit of claim 1 wherein the seat assembly further comprises a seat locking mechanism comprising a locking seat position knob which engages indexing seat-position holes on the frame assembly.

4. The rowing device conversion kit of claim 1 wherein the roller seat frame further comprises a seat elevation support; and a seat track retaining bracket.

5. The rowing device conversion kit of claim 1 wherein the foot plate assembly further comprises a foot support element; and a foot retention element.

6. The rowing device conversion kit of claim 5 wherein the foot plate assembly further comprises a pair of bridge straps; and a pair of molded foot beds.

7. The rowing device conversion kit of claim 1 wherein the rigger assembly further comprises a pair of oarlock pivot points;

and a coupling splice lock.

8. The rowing device conversion kit of claim 1 further comprising a two-part rigger; and a pair of gussets provided on the foot assembly.

9. The rowing device conversion kit of claim 1 further comprising a carry bag.

10. A sculling boat comprising a stand up paddleboard comprising a top surface, and rails;

a frame assembly comprising side members with seat tracks, and a plurality of frame attachment clamps, such that the frame attachment clamps engage the rails of the stand up paddleboard, thereby removably securing the frame assembly to the top surface of the stand up paddleboard;

a seat assembly comprising a roller seat frame, a seat, and a plurality of wheels supported in the seat tracks;

a foot plate assembly comprising a foot plate, and bindings; and a rigger assembly comprising a first side arm comprising a lower portion extending through the first side gusset, and an elevated portion, a first side gusset alignment pin configured to secure the first side arm to the first side gusset, a second side arm comprising, a lower portion extending through the second side gusset, and an elevated portion, a second side gusset alignment pin configured to secure the second side arm to the second side gusset, and a pair of oarlocks attached to the elevated portions of the side arms.

11. The sculling boat of claim 10 further comprising an inflatable stand up paddleboard comprising a top surface, and rails.

12. The sculling boat of claim 10 wherein the plurality of frame attachment clamps further comprise straps and buckles, such that the straps can be tightened to secure the attachment clamps and frame assembly.

13. The sculling boat of claim 10 wherein the seat assembly further comprises a seat locking mechanism comprising a locking seat position knob which engages indexing seat-position holes on the frame assembly.

14. The sculling boat of claim 10 wherein the roller seat frame further comprises a seat elevation support; and a seat track retaining bracket.

15. The sculling boat of claim 10 wherein the foot plate assembly further comprises a pair of heel straps; and a pair of bridge straps.

16. The sculling boat of claim 10 wherein the rigger assembly further comprises a pair of oarlock pivot points;

and a coupling splice lock.

17. A method of converting a stand up paddleboard to a sculling boat, the method comprising providing a stand up paddleboard comprising a top surface and rails;

providing a rowing boat conversion kit comprising a frame assembly comprising side members with seat tracks, and a plurality of frame attachment clamps;

a seat assembly comprising a roller seat frame, a seat, and a plurality of wheels supported in the seat tracks, an foot plate assembly comprising a foot plate, and bindings, and a rigger assembly comprising a rigger frame a rigger assembly comprising a rigger assembly comprising a first side arm comprising a lower portion extending through the first side gusset, and an elevated portion, a first side gusset alignment pin configured to secure the first side arm to the first side gusset, a second side arm comprising, a lower portion extending through the second side gusset, and an elevated portion, a second side gusset alignment pin configured to secure the second side arm to the second side gusset, and a pair of oarlocks attached to the elevated portions of the side arms;

attaching the frame assembly to the top surface of the stand up paddleboard by securing the plurality of frame attachment clamps to the rails of the stand up paddleboard with straps; and sliding the rigger assembly into place and securing it.

18. The method of claim 17 further comprising providing an inflatable stand up paddleboard; and inflating the inflatable stand up paddleboard.

19. The method of claim 17 further comprising removing the frame assembly by removing the plurality of frame attachment clamps;

removing pins, uncoupling the splice lock, and sliding the rigger assembly out of the rigger slide ports.

20. The method of claim 19 further comprising breaking down the rigger into two pieces.

* * * * *